US010214954B2

(12) United States Patent
Plummer

(10) Patent No.: US 10,214,954 B2
(45) Date of Patent: Feb. 26, 2019

(54) THERMALLY BROKEN DOOR PANEL

(71) Applicant: GlassCraft Door Company, Houston, TX (US)

(72) Inventor: John B. Plummer, Houston, TX (US)

( * ) Notice: Subject to any disclaimer, the term of this patent is extended or adjusted under 35 U.S.C. 154(b) by 0 days.

(21) Appl. No.: 16/025,774

(22) Filed: Jul. 2, 2018

(65) Prior Publication Data

US 2018/0313137 A1 Nov. 1, 2018

Related U.S. Application Data

(63) Continuation-in-part of application No. 15/713,287, filed on Sep. 22, 2017, now Pat. No. 10,012,018, and a continuation-in-part of application No. 15/713,292, filed on Sep. 22, 2017, now Pat. No. 10,030,434, and a continuation-in-part of application No. 15/713,315, filed on Sep. 22, 2017, now abandoned.

(60) Provisional application No. 62/477,077, filed on Mar. 27, 2017, provisional application No. 62/477,258, filed on Mar. 27, 2017.

(51) Int. Cl.

| | |
|---|---|
| ***E06B 3/58*** | (2006.01) |
| ***E06B 3/64*** | (2006.01) |
| ***E06B 3/54*** | (2006.01) |
| ***E06B 5/12*** | (2006.01) |

(52) U.S. Cl.

CPC ..... *E06B 3/5892* (2013.01); *E06B 3/5481* (2013.01); *E06B 3/645* (2013.01); *E06B 5/12* (2013.01)

(58) Field of Classification Search

CPC ..... E06B 3/5892; E06B 3/5481; E06B 3/645; E06B 5/12

See application file for complete search history.

(56) References Cited

U.S. PATENT DOCUMENTS

| | | | | |
|---|---|---|---|---|
| 2,582,467 | A * | 1/1952 | Sylvan | E06B 3/72 49/501 |
| 3,599,703 | A * | 8/1971 | Mennuto | E06B 3/7001 160/90 |
| 4,327,535 | A * | 5/1982 | Governale | E06B 3/5892 49/501 |
| 5,105,597 | A * | 4/1992 | Wilkening | E06B 3/5892 52/455 |
| 5,834,124 | A * | 11/1998 | Pease, III | B32B 17/10045 428/430 |
| 6,347,491 | B1 * | 2/2002 | Legrand | F16B 5/0258 296/201 |
| 6,546,682 | B1 * | 4/2003 | DeBlock | B32B 17/10 52/204.68 |
| 6,553,735 | B1 * | 4/2003 | Wang Chen | E06B 3/5892 52/204.6 |

(Continued)

*Primary Examiner* — Jeanette E Chapman

(74) *Attorney, Agent, or Firm* — Buskop Law Group, P.C.; Wendy Buskop

(57) ABSTRACT

A door assembly with the dual support connector has a door panel, a glass pane, a dual support connector assembly, a fixed sealing frame for engaging the dual support connector assembly, a seal-less removable frame for attaching to the attachment (dual support connector assembly) on an opposite side of the fixed sealing frame, and a fastener engaging the dual support connector assembly to the fixed sealing frame. The dual support connector assembly has a clip body, a door flange extending from the clip body, a glass flange extending from the clip body in parallel with the door flange.

18 Claims, 12 Drawing Sheets

(56) References Cited

U.S. PATENT DOCUMENTS

| | | | | |
|---|---|---|---|---|
| 6,574,935 | B2 * | 6/2003 | Wang Chen | E06B 3/5892 52/204.62 |
| 8,904,733 | B2 * | 12/2014 | Thompson | E06B 1/36 49/504 |
| 10,012,018 | B1 * | 7/2018 | Plummer | E06B 3/5892 |
| 10,030,434 | B1 * | 7/2018 | Plummer | E06B 3/5892 |
| 2008/0245003 | A1 * | 10/2008 | Kon | E06B 3/5892 52/208 |

* cited by examiner

THERMALLY BROKEN DOOR PANEL

CROSS REFERENCE TO RELATED APPLICATIONS

The present application is a Continuation In Part and claims priority to pending U.S. patent application Ser. No. 15/713,287 filed on Sep. 22, 2017 for "DUAL SUPPORT CONNECTOR ASSEMBLY"; pending U.S. patent application Ser. No. 15/713,292 filed on Sep. 22, 2017 for "DOOR ASSEMBLY WITH DUAL SUPPORT CONNECTOR ASSEMBLY"; pending U.S. patent application Ser. No. 15/713,315 filed on Sep. 22, 2017 for "DOOR ASSEMBLY WITH DUAL SUPPORT CONNECTOR ASSEMBLY"; U.S. Provisional Patent Application Ser. No. 62/477,077 filed on Mar. 27, 2017, for "DOOR ASSEMBLY WITH DUAL SUPPORT CONNECTOR ASSEMBLY"; and U.S. Provisional Patent Application Ser. No. 62/477,258 filed on Mar. 27, 2017, for "CARVED HIGH STRENGTH DOOR". These references are hereby incorporated in their entirety.

FIELD

The present embodiment generally relates to door assembly with the dual support connector.

BACKGROUND

A need exists for door frame prevents transfer energy quickly and efficiently from the front of the door to the back of the door.

The present embodiments meet these needs.

BRIEF DESCRIPTION OF THE DRAWINGS

The detailed description will be better understood in conjunction with the accompanying drawings as follows.

Figure 1:
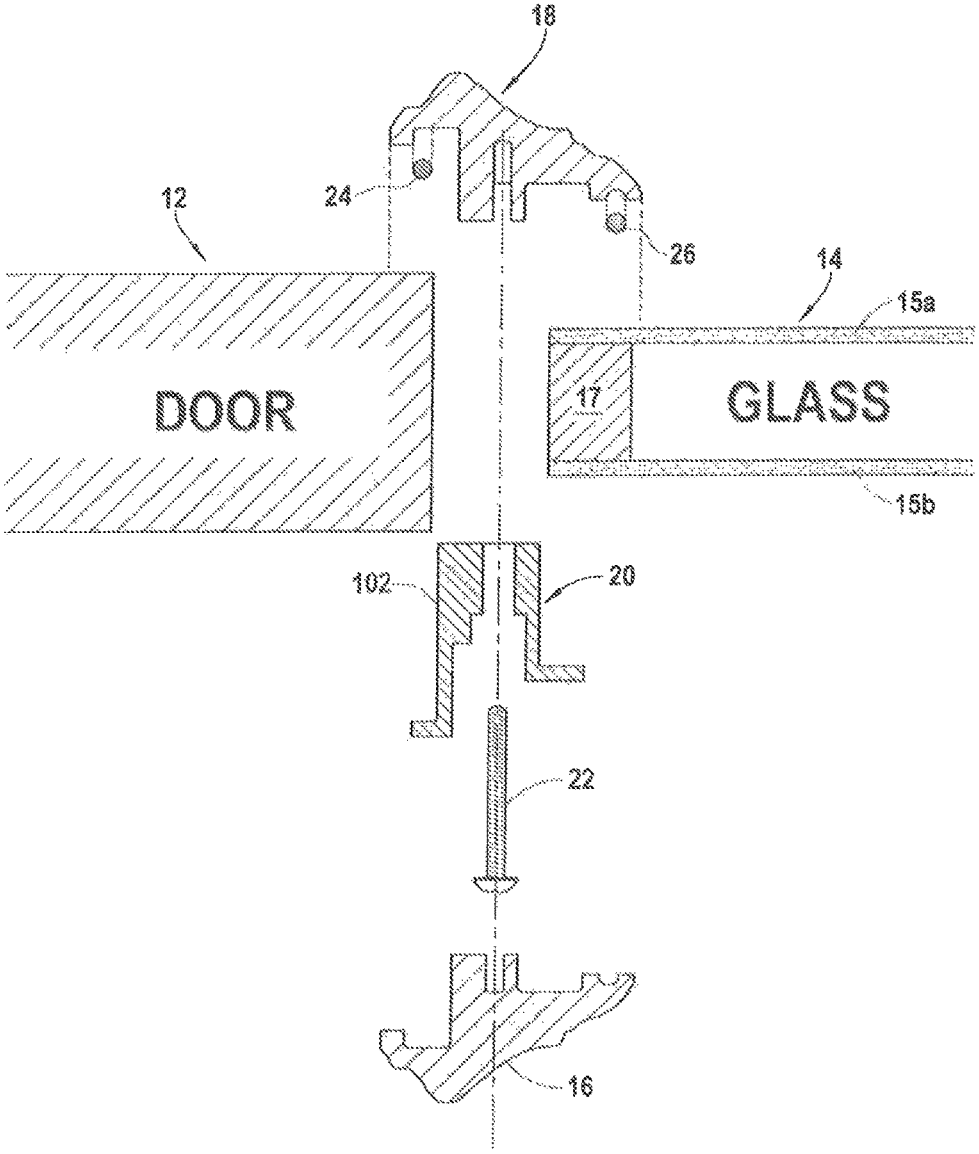
FIG. 1 depicts an exploded view of a door assembly with the dual support connector according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present invention relates to an improved door assembly with a dual support connector assembly that does not require corner clips.

The door assembly with the dual support connector for door without corner clips can have a door panel, and a glass pane.

The improved door has a thermally broken door panel with a thermal break core that can be a solid composite.

The improved door has a rigid thermal break edge disposed around a top edge, a first side edge, a bottom edge and a second side edge of the thermal break core forming a thermal barrier.

The improved door has a front metal panel secured to one side of the thermal break core over the rigid thermal break edge.

The improved door has a back metal panel secured on an opposite side of the thermal break core over the rigid thermal break edge forming the thermally broken door panel.

The thermally broken door panel preventing the front metal panel from touching the back metal panel.

The improved door has an opening in the thermally broken door panel and an insert fits within the opening in the thermally broken door panel.

The improved door uses a dual support connector assembly to hold the insert in place in the thermally broken door panel.

The dual support connector assembly is positioned between the door and glass pane. The dual support connector assembly can include a clip body, a door flange extending from the clip body, a glass flange extending from the clip body in parallel with the door flange.

In embodiments, the improved door assembly with the dual support connector for door without corner clips includes a fixed sealing frame for engaging the dual support connector assembly.

A seal-less removable frame 16 for attaching to the dual support connector assembly on an opposite side of the fixed sealing frame.

In embodiments, the improved door assembly with the dual support connector includes a fastener for engaging the dual support connector assembly to the fixed sealing frame.

The embodiments provide secure connection, which prevents a door or glass pane from breaking during severe weather, such as a hurricane.

The improved thermally broken single panel door with a dual support connector assembly without corner clips prevents little kids from severe burns, such as third degree burns when kids touch the back metal panel when there is a metal connection to the front metal panel.

The improved thermally broken door panel with a dual support connector assembly without corner clips prevents the inside of a door from frosting, then melting, and causing persons injuries from slipping.

The construction of the improved thermally broken force resistant entry door having a thermally broken door panel enables the installation of a multipoint lock set, rather than a standard single point lock set, which increases the resistance to forced entry.

The construction of the improved thermally broken force resistant entry door having a thermally broken door panel can use recycled materials, such a BIOFOAM™ of Glasscraft Door Company of Houston, Tex., which creates a door with a smaller carbon footprint.

A significant feature of the improved thermally broken force resistant entry door having a thermally broken door panel is that the energy use, such as electric use of a facility, such as a home, is reduced by at least 3% to 25%.

The following terms are used herein:

The term "a thermally broken door panel" refers to a portion of a door assembly which is a door panel for attaching to a door frame, wherein the door panel prevents the transfer of energy in Joules from a side of the metal door panel to another side of the metal door panel via a metal to metal connection.

The term "a thermal break core" refers to a rigid central material of a door panel, which does not provide a metal to metal connection between the front metal plate and the back metal plate of the door panel. The thermal break core provides reduced low energy transfer between a front plate and a back plate of a door panel.

The embodiments, allow the glass panel to be easily removable for cleaning purposes.

Now turning to the Figures, FIG. 1 an exploded view of a door assembly with the dual support connector according to one or more embodiments.

The door assembly with the dual support connector has a door panel 12 and a glass panel 14.

In embodiments, a dual support connector assembly 20 is positioned between the door panel 12 and glass panel 14.

The door assembly with the dual support connector includes a fixed sealing frame 18. The fixed sealing frame engages the dual support connector assembly 20.

In embodiments, the door assembly with the dual support connector has a seal-less removable frame 16. The seal-less removable frame 16 attaches to the dual support connector assembly 20 on an opposite side of the door panel 12 and glass panel 14 from the fixed sealing frame 18.

A fastener 22 engages the dual support connector assembly 20 to the fixed sealing frame 18.

The door assembly with the dual support connector has a first seal 24 between the door panel 12 and the fixed sealing frame 18.

The door assembly with the dual support connector has a second seal 26 between the glass panel 14 and the fixed sealing frame 18.

In embodiments, the door assembly with dual support connector 20 has a plurality of compression brads. Each compression brad penetrates the seal-less removable frame 16 and clip body 102 at an angle between 10 degrees and 90 degrees in a spaced apart relationship.

Figure 2:
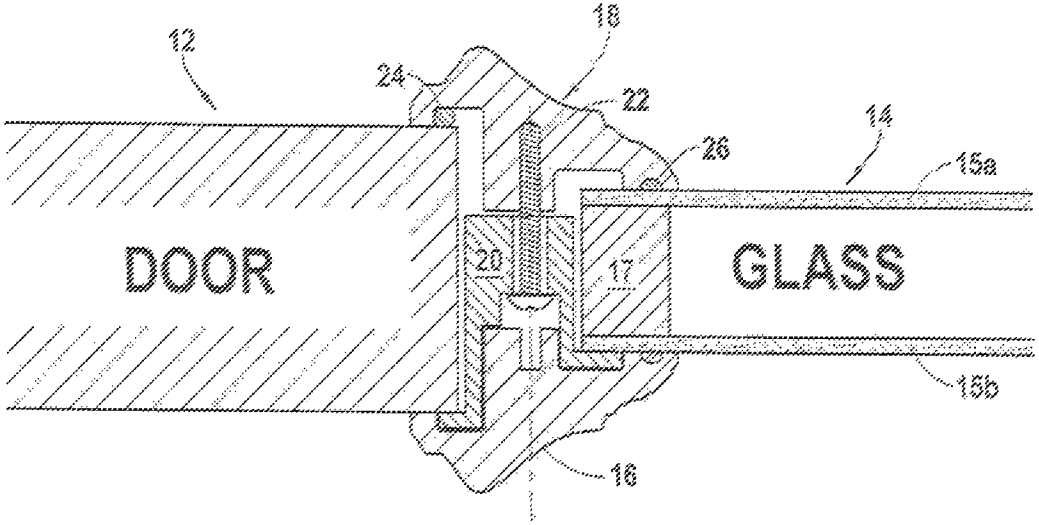
FIG. 2 depicts an assembled view of the elements of a door assembly with the dual support connector according to one or more embodiments.

FIG. 2 depicts an assembled view of the elements of a door assembly with the dual support connector according to one or more embodiments.

The door assembly with the dual support connector has a door panel 12 and a glass panel 14 attached to the fixed sealing frame 18 engaging the door panel and glass panel.

In embodiments, the door assembly with the dual support connector 20 has a seal-less removable frame 16. The seal-less removable frame 16 attaches to the dual support connector assembly 20 on an opposite side of the door panel 12 and glass panel 14 from the fixed sealing frame 18.

The glass panel can have a plurality of glass panes 15*a* and 15*b* separated by a spacer/sealant 17.

The fixed sealing frame 18 is engaged with the dual support connector assembly 20 via fastener 22. The seal-less removable frame 16 has brads applying compression to the frame for additional seal pressure.

In embodiments, the seal-less removable frame 16 is attached to the dual support connector assembly 20 on an opposite side of the door panel 12 and glass panel 14 from the fixed sealing frame 18.

The fixed sealing frame 18 is engaged with the dual support connector assembly 20 via a fastener 22.

Figure 3A:
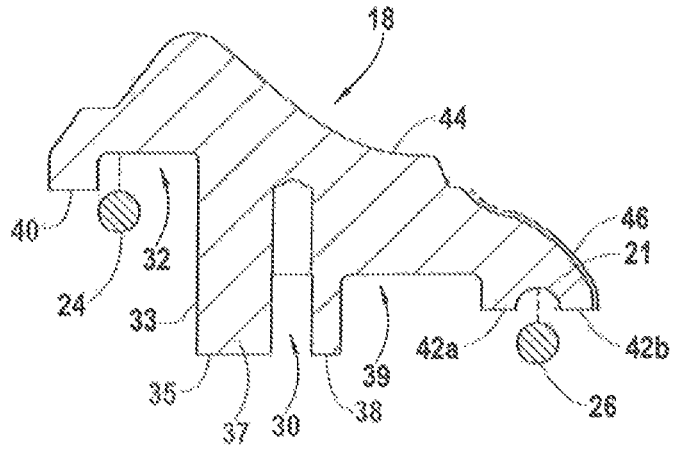
FIG. 3A depicts cross sectional view of the fixed sealing frame according one or more embodiments.

FIG. 3A depicts cross sectional view of the fixed sealing frame 18 according one or more embodiments.

The fixed sealing frame 18 includes a fixed sealing frame profile 44. The fixed sealing frame profile 44 is covered with a coating layer 46.

A door contact surface 40 extends from the fixed sealing frame profile 44.

The fixed sealing frame 18 includes a side flex and sealing gap surface 33. The side flex and sealing gap surface 33 extends from the door contact surface 40.

An upper flex and sealing gap 32 is formed between the door contact surface 40 and the side flex and sealing gap surface 33.

In embodiments, a lower flex and sealing gap surface 35 extends from the side flex and sealing gap surface 33 to form a first channel engagement member 37.

A second channel engagement member 38 is formed in parallel to the first channel engagement member 37 creating a first alignment cavity 30.

A flex gap 39 is formed between the second channel engagement member 38 and a first glass contact surface 42*a*.

In embodiments, a second glass contact surface 42*b* formed in parallel to the first glass contact surface 42*a* containing a first seal 24.

A second seal 26 is located between the door contact surface 40 and the side flex and sealing gap surface 33.

In embodiments a texture, a smooth surface or a woodgrain surface is formed on the fixed sealing frame profile 44.

In embodiments, a shape for the fixed sealing frame profile 44 is selected from the group consisting of a rectangle, a half round, or a decorative molding shape.

The fixed sealing frame profile 44 can have a coating layer 46. The coating layer 46 can consists of a stain, a paint, a sealant, or a primer coat.

Figure 3B:
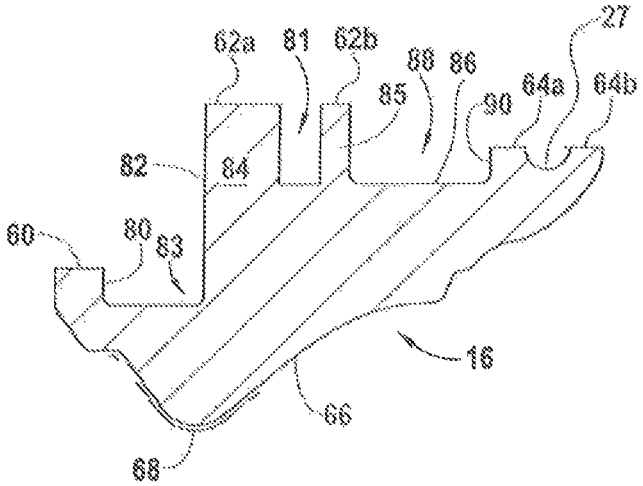
FIG. 3B depicts cross sectional view of the seal-less removable frame 16 according to one or more embodiments.

FIG. 3B depicts cross sectional view of the seal-less removable frame 16 according to one or more embodiments.

The seal-less removable frame 16 includes a seal-less removable frame profile 66 with a paint layer 68.

In embodiments, the seal-less removable frame 16 includes a door contact surface 60. The door contact surface 60 extends from the seal-less removable frame profile 66.

A first side gap surface 80 extends from the door contact surface 60.

A second side gap surface 82 extends from the first side gap surface 80 to form a rigid gap 83.

In embodiments, the seal-less removable frame 16 includes first alignment channel member 84.

A first clip surface 62*a* is formed on the first alignment channel member 84.

In embodiments, the seal-less removable frame 16 includes a second alignment channel member 85.

A second clip surface 62*b* is formed on the second alignment channel member 85 in parallel with the first clip surface 62*a*.

In embodiments, the seal-less removable frame 16 includes a second alignment cavity 81 formed between the first alignment channel member 84 and second alignment channel member 85.

The seal-less removable frame 16 includes a third side gap surface 86 extending from the second clip surface 62*b*.

A rigid gap 88 is formed between the second alignment channel member 85 and a fourth side gap surface 90.

In embodiments, the seal-less removable frame 16 includes a first glass contact surface 64*a*.

A second glass contact surface 64*b* is formed in parallel to the first glass contact surface 64*a* connecting to the seal-less removable frame profile 66.

In embodiments, a textured surface, a smooth surface or a woodgrain surface can be formed on the seal-less removable frame profile 66.

In embodiments, a shape for the seal-less removable frame profile 66 can be selected from the group consisting of a rectangle, a half round, or a decorative molding shape.

The seal-less removable profile can have a coating layer 68. The coating layer 68 can consists of a stain, a paint, a sealant, or a primer coat.

Figure 4:
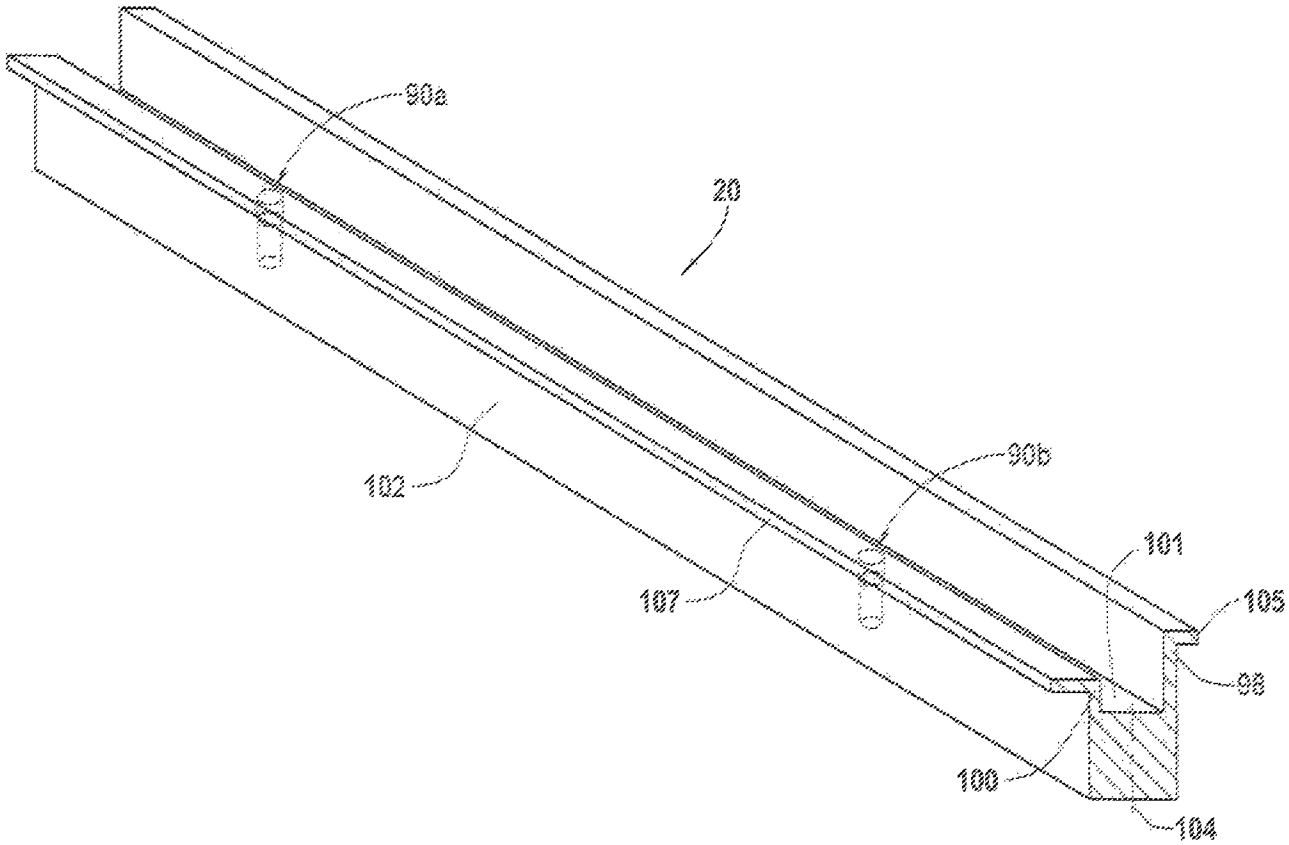
FIG. 4 depicts a perspective view of the dual support connector assembly according to one or more embodiments.

FIG. 4 depicts a perspective view of the dual support connector assembly 20 according to one or more embodiments.

The dual support connector assembly 20 includes a clip body 102. A door flange 98 extends from the clip body 102.

The clip body 102 has a pair of through holes 90*a* and 90*b*.

In embodiments, the door flange 98 includes a door flange lip 105 extending at an angle from 80 degrees to 100 degrees from a central axis 104 of the clip body 102.

A glass flange 100 extends from the clip body 102 in parallel with the door flange 98.

In embodiments, the glass flange 100 includes a glass flange lip 107 extending at an angle from 80 degrees to 100 degrees from a central axis 104 of the clip body 102.

In embodiments, the height of the door flange 98 and the height of the glass flange 100 are unequal.

Figure 5:
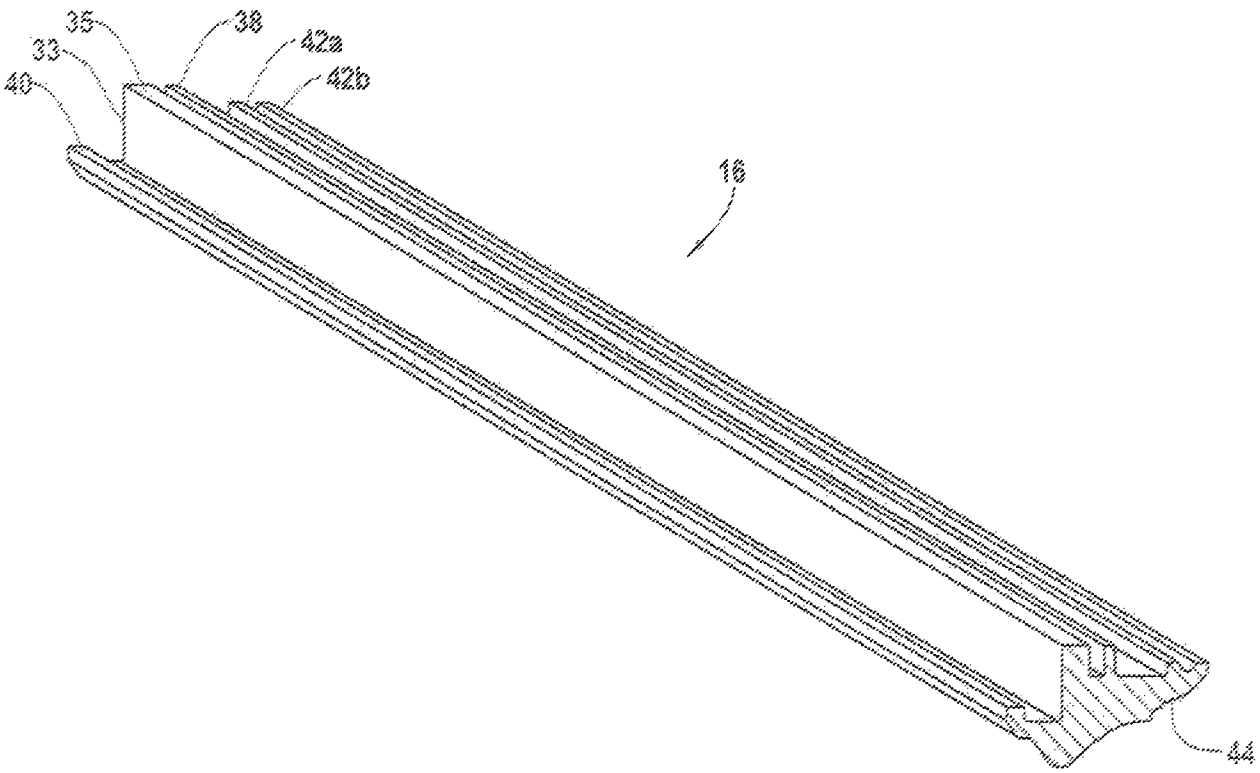
FIG. 5 depicts a perspective view of the fixed sealing frame according to one or more embodiments.

FIG. 5 depicts a perspective view of the fixed sealing frame 18 according to one or more embodiments.

The fixed sealing frame 18 has a door contact surface 40 extending from the fixed sealing frame profile 44.

A lower flex and sealing gap surface 35 extends from the side flex and sealing gap surface 33.

In embodiments, the fixed sealing frame 18 has a second channel engagement member 38 parallel to the lower flex and sealing gap surface 35.

The second channel engagement member 38 is parallel to a first glass contact surface 42*a* and a second glass contact surface 42*b*.

Figure 6:
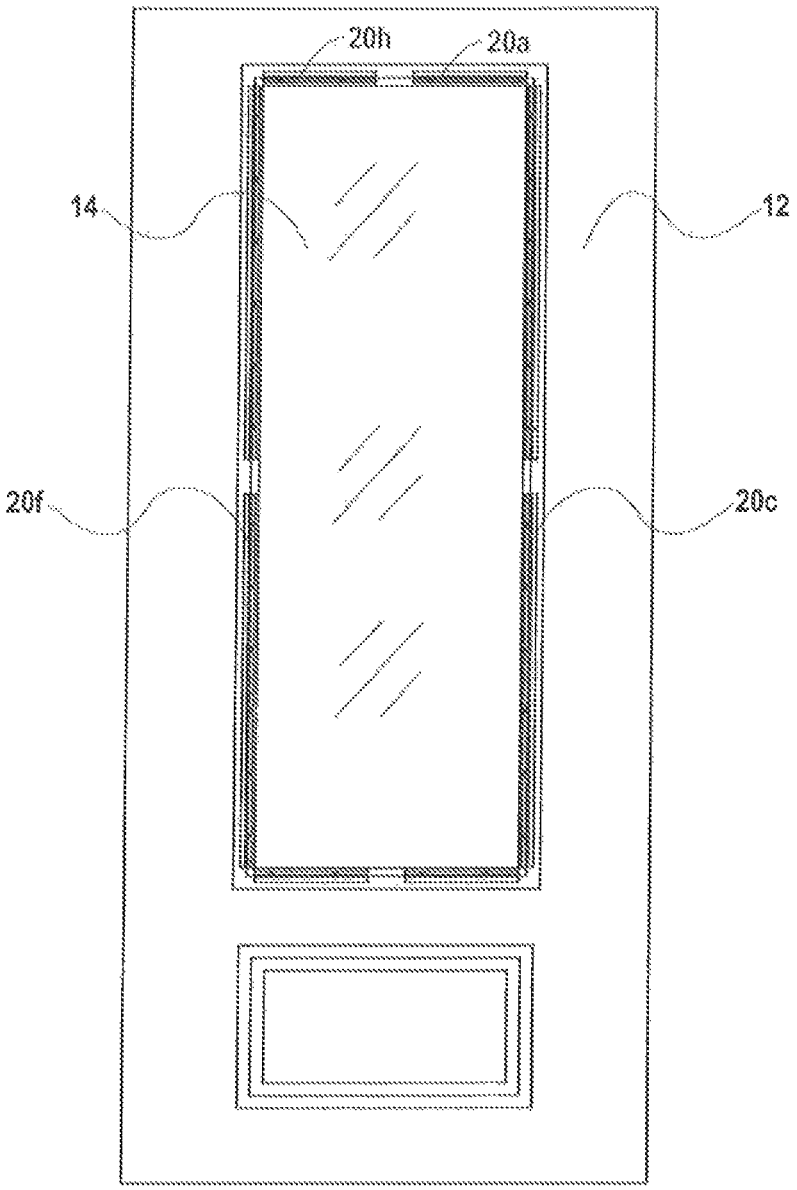
FIG. 6 is a front view of the connectors mounted in the fixed sealing frame according to one or more embodiments.

FIG. 6 depicts a front view of a door panel 12 with dual support connector assembly and according to one or more embodiments.

The door is shown with a door panel 12, a glass panel 14, and dual support connector assembly 20*a*-20*h* positioned between the door panel 12 and glass panel 14.

Figure 7:
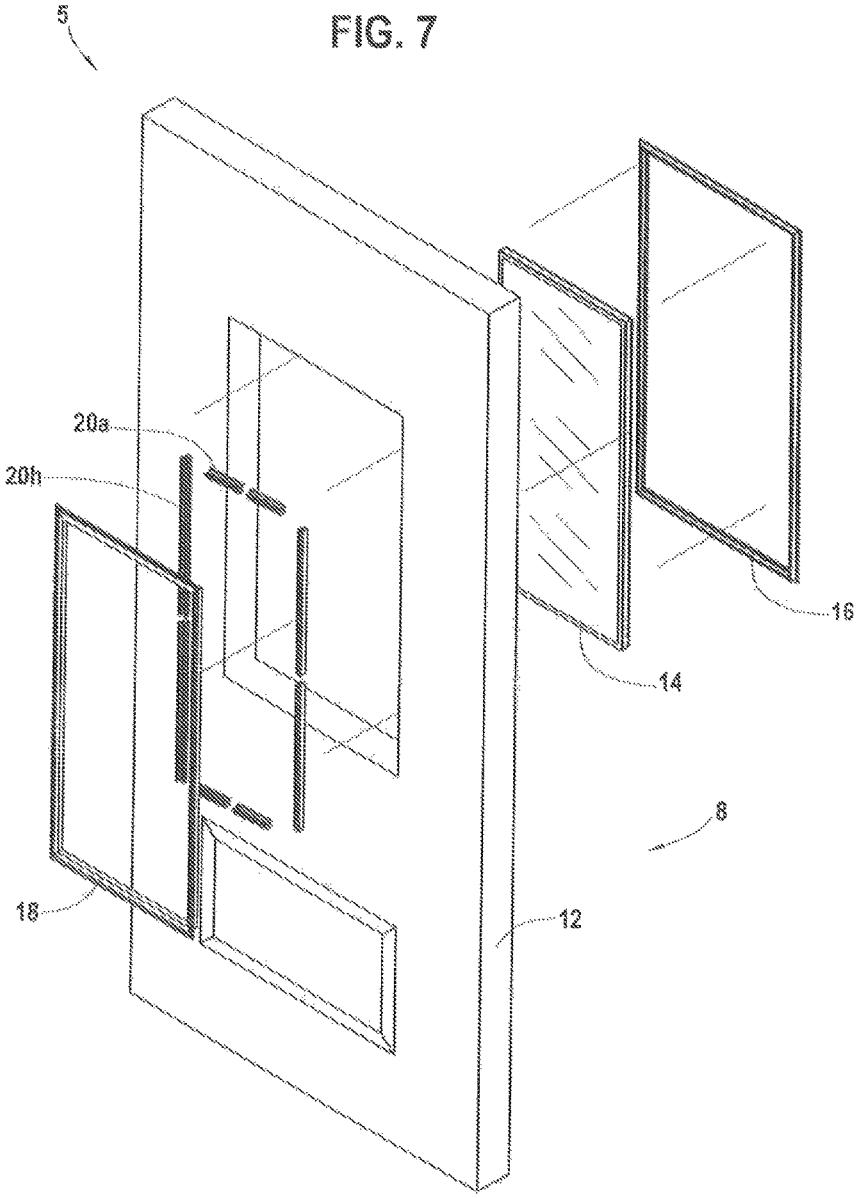
FIG. 7 is an exploded view of the assembly according to one or more embodiments.

FIG. 7 depict and exploded view of a door panel 12 with dual support connector assembly without corner clips according to one or more embodiments.

The door is shown with a door panel 12, a glass panel 14, and dual support connector assembly 20*a*-20*h* positioned between the door panel 12 and glass panel 14.

A fixed sealing frame 18 is shown with a fasteners 22*a*-22*r* for engaging the fixed sealing frame 18 to the dual support connector assembly 20*a*-20*h*.

A seal-less removable frame 16 attaches to the dual support connector assembly 20*a*-20*h* on an opposite side of the door panel 12 and glass panel 14 from the fixed sealing frame 18.

Figure 8:
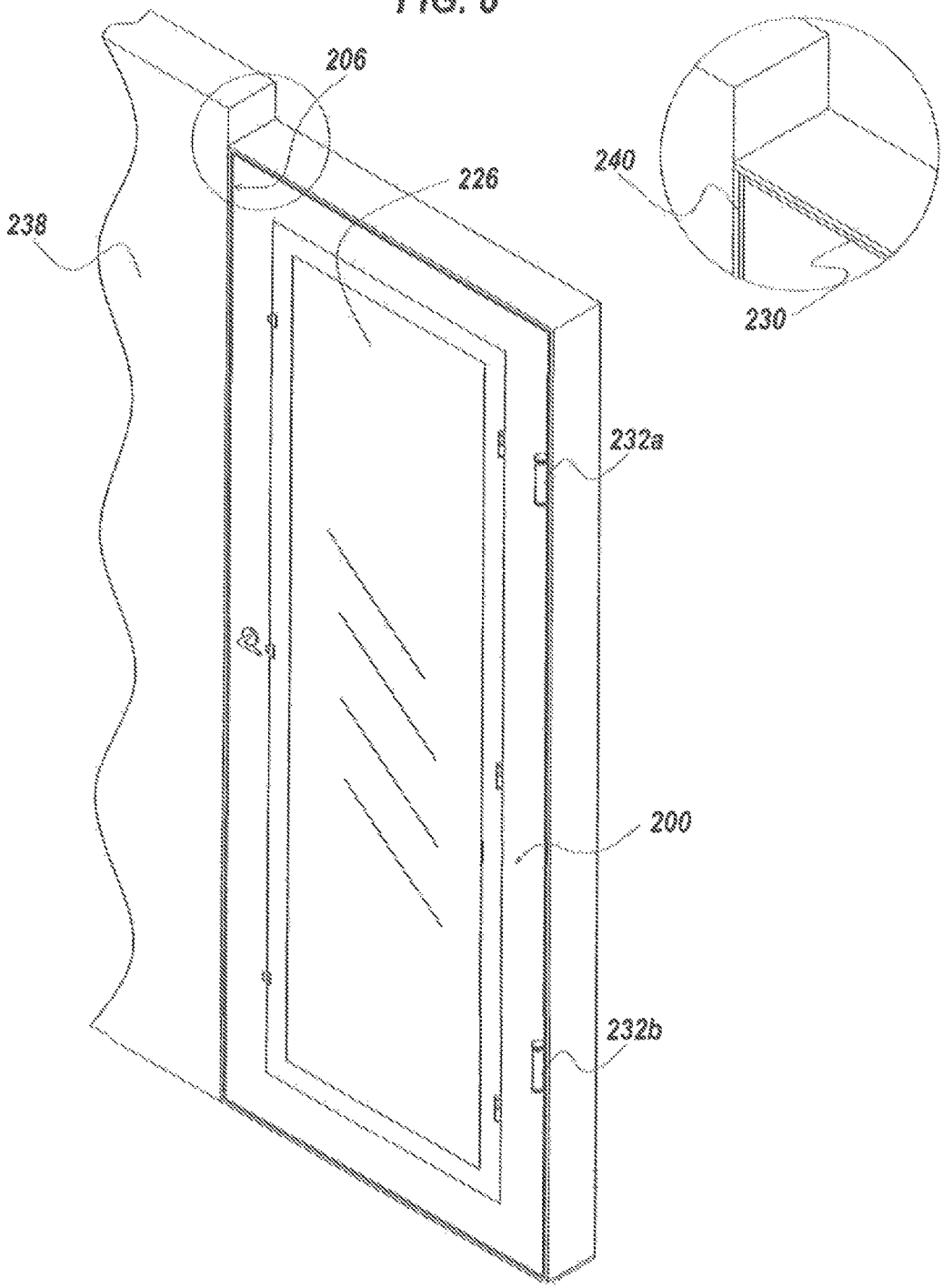
FIG. 8 depicts a thermally broken door panel connected to a facility according to one or more embodiments.

FIG. 8 a reduced thermally conductive door frame 230 attached to a facility 238 for supporting the thermally broken door panel 200.

In embodiments, the reduced thermally conductive door frame 230 attached to the facility 238 prevents thermal energy transfer in a range from 10 degrees to 60 degrees Fahrenheit from the outside of the facility to an inside of the facility, wherein the reduced thermally conductive door frame is not a metal door frame.

A plurality of hinges 232*a* and 232*b* affix the thermally broken door panel 200 to the thermally insulating door frame 230 in a pivoting relationship.

In embodiments, the hinge can be a pin hinge having a first segment providing a receptacle portion for receiving a projecting portion from a second segment for quick installation.

A metal reinforcement member 240 can be mounted to a facility opening, connecting to the thermally insulating door frame 230.

In embodiments, the metal reinforcing member 240 can be made from steel, aluminum and has a thickness from 28 gauge to 5 gauge steel or aluminum and have width from 1 inch to the width of the thermally insulating door frame.

In embodiments, the improved thermally broken door can be force entry resistant and can resists forced entry using pressures from 10 psi to 500 psi.

A rigid thermal break edge 206 is disposed around a top edge, a first side edge, a bottom edge and a second side edge of the thermal break core forming a thermal barrier between a front and a back metal panel mounted to either side of the core.

An insert 226 is shown installed within an opening in the thermally broken door panel.

FIGS. 9A-9D show details of the thermally broken door panel 200.

The thermally broken door panel, in an embodiment, can have an opening 224 in the thermally broken door panel into which an insert 226 can be installed.

The insert 226 fits within the opening 224 in the thermally broken door panel.

Figure 9A:
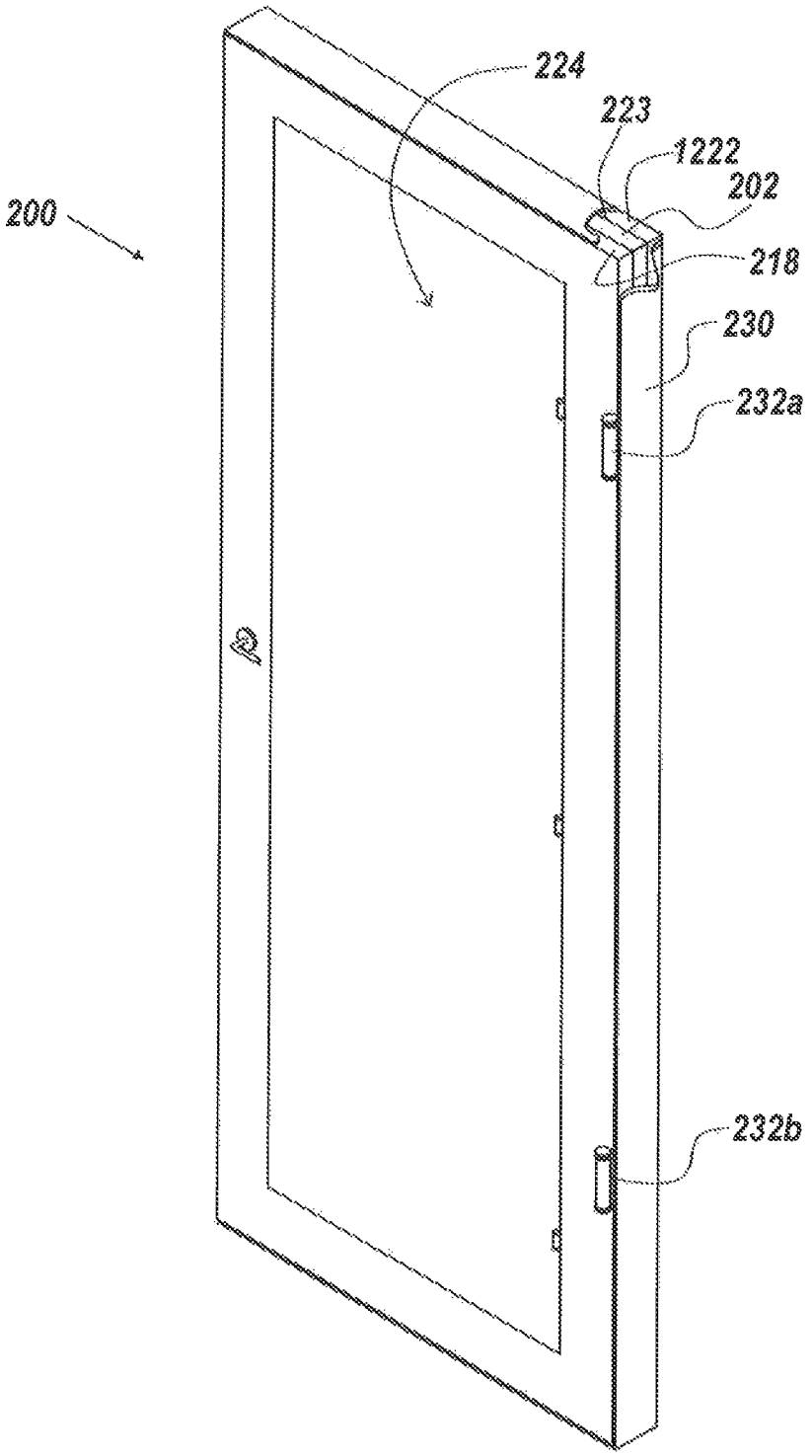
FIG. 9A is a detail of the thermally broken door panel according to one or more embodiments.
Figure 9B:
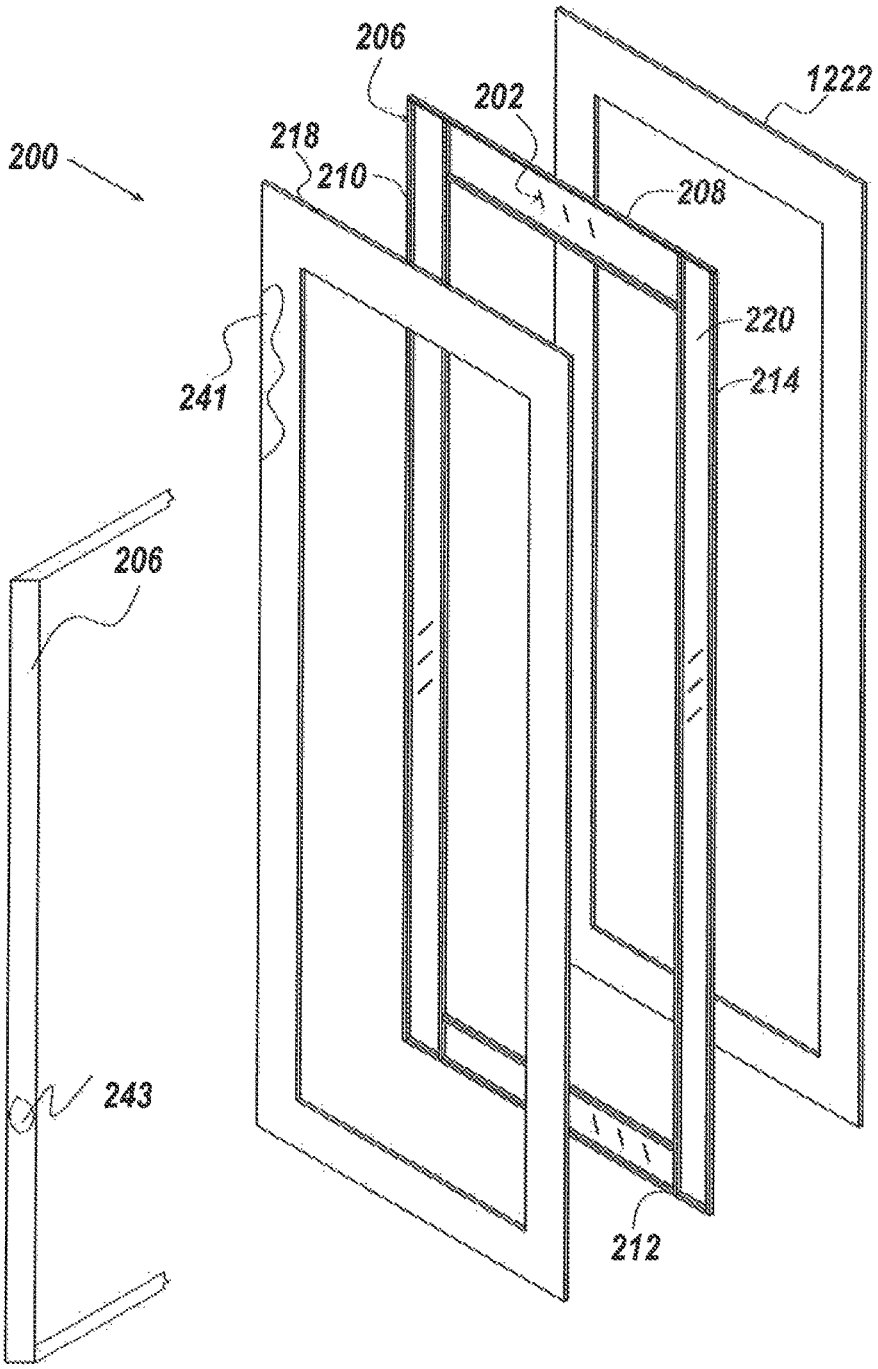
FIG. 9B depicts a exploded view of the thermally broken door panel.
Figure 9C:
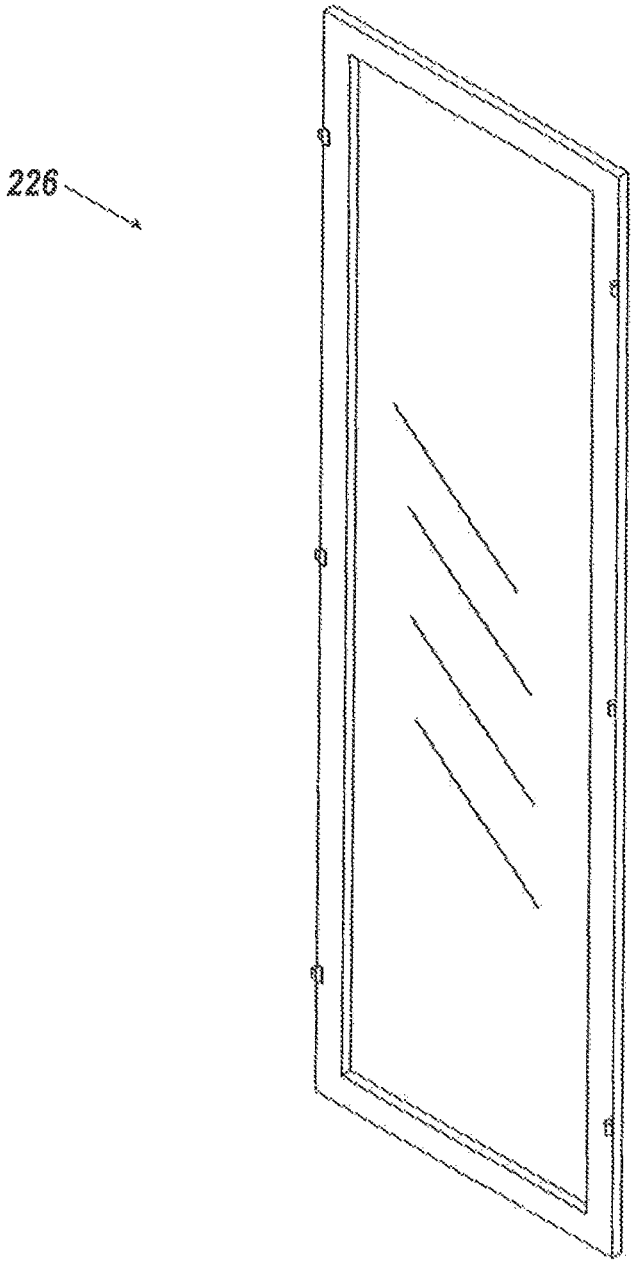
FIG. 9C depicts an insert for a thermally broken door panel according to one or more embodiments.

In embodiments, as specifically shown in FIGS. 9A and 9B, the rigid thermal break edge 206 surrounds the thermal break core 202. The rigid thermal break edge 206 has a top edge 208, a first side edge 210 of the thermal break core 202, a bottom edge 212 of the thermal break core 202 and a second side edge 214 of the thermal break core 202 forming a thermal barrier.

The thermally broken door panel 200 has a thermal break core 202 with a front metal panel 218 secured to one side 220 of the thermal break core over the rigid thermal break edge 206.

A back metal panel 1222 secured on an opposite side of the thermal break core over the rigid thermal break edge forms the thermally broken door panel.

The thermally broken door panel prevents the front metal panel from touching the back metal panel.

The thermal break core 202 can be made from a solid composite, such as a wood composite with resin, or a polymer composite with some wood particles, or a blend of two crystalline polymers, such as polyethylene and polypropylene.

A plurality of hinges 232*a* and 232*b* (shown in FIG. 9A) affix the thermally broken door panel 200 to the thermally insulating door frame 230 in a pivoting relationship.

In embodiments, (shown in FIG. 9A) the front metal panel 218 is secured to one side of the thermal break core over the rigid thermal break edge 206 and the back metal panel 1222 is secured on an opposite side 223 of the thermal break core over the rigid thermal break edge 206 forming the thermally broken door panel 200. FIG. 9B also shows the rigid thermal break edge 206.

In embodiments, the improved thermally broken force resistant entry door can have a powder coating 241 or paint 243 disposed over the door panel and the thermally insulating door frame as shown in FIG. 9B.

The thermal break core with rigid thermal break edge prevents thermal energy transfer from front metal panel to back metal panel in a range from 10 degrees to 60 degrees Fahrenheit. In this embodiment, the thermally broken door panel has a thermal break core 202 made from a non-metal material.

In embodiments, the rigid thermal break edge 206 can have a thickness from 5 millimeters to 100 millimeters.

Figure 9D:
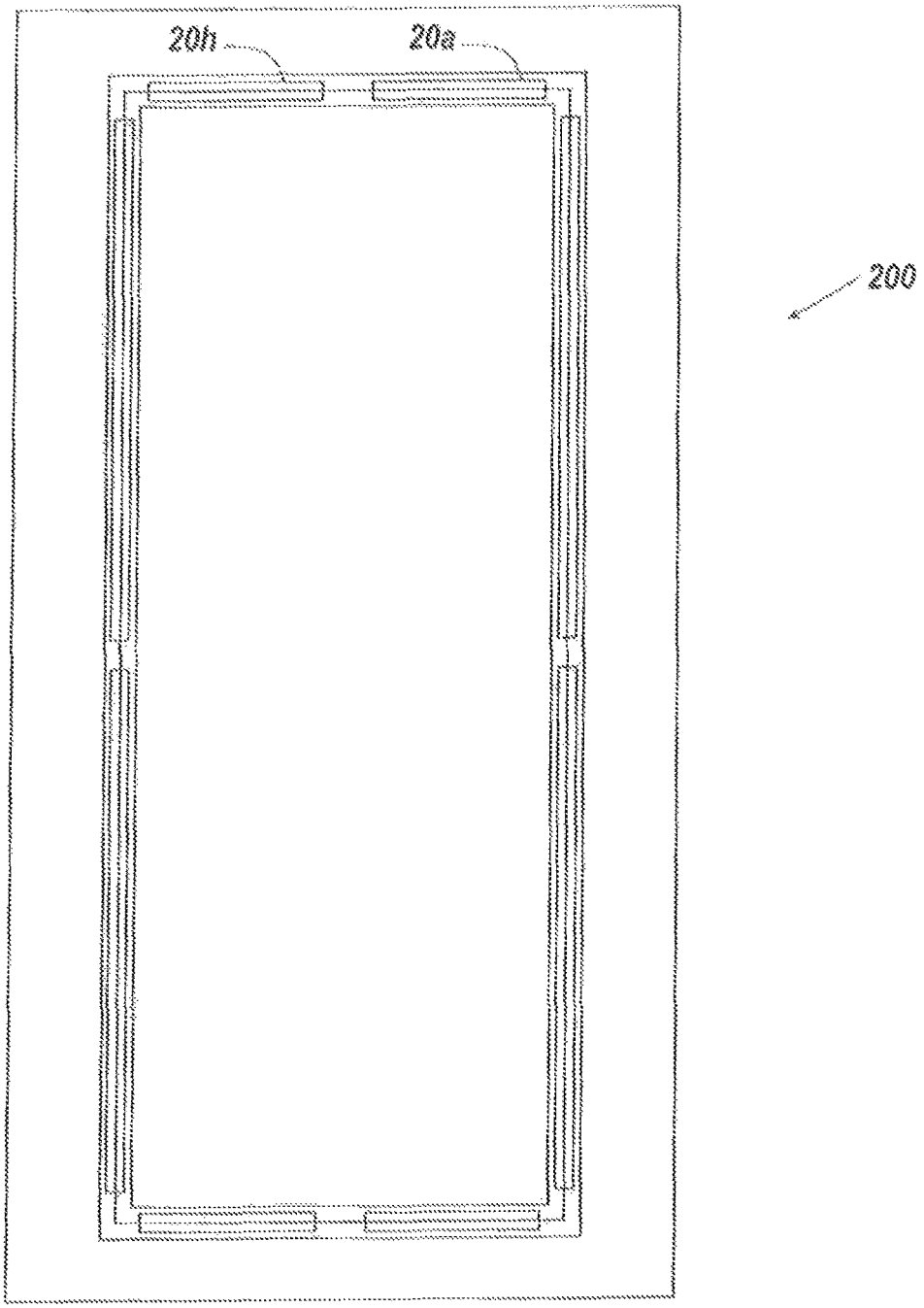
FIG. 9D depicts a thermally broken door panel with dual support connector assembly according to one or more embodiments.

FIG. 9D specifically shows dual support connector assemblies 20*a*-20*h* is positioned between the insert and the opening simultaneously.

In embodiments, a front seal is between the thermally broken door panel and the fixed sealing frame for sealing the fixed sealing frame to the thermally broken door panel. A back seal is between the insert and the fixed sealing frame for sealing the fixed sealing frame to the insert.

The thermally broken door panel with the improved dual support connector assembly without corner clips is secured between the fixed sealing frame, the thermally broken door panel, the insert, and the seal-less removable frame opposite side of the fixed sealing frame without touching the seal-less removable frame creating an easily removable insert with a secure connection, which prevents and insert from breaking during severe weather, including a hurricane.

In embodiments, the improved thermally broken force resistant entry door can have a thermally insulating door frame and the rigid thermal break made from either: (i) a wood plastic composite of a blend of wood flour and polyvinyl chloride or (ii) wood.

In embodiments, the improved thermally broken force resistant entry door front metal panel and the back metal panels can have a thickness between 0.2 mm to 4 mm.

Example 1

An improved thermally broken single panel door with a dual support connector assembly without corner clips is described below.

A thermal break core can be used to form the thermally broken door panel.

The thermal break core can be a solid composite. The thermal break core can be 80 inches tall and 36 inches wide and 1.75 inches in thickness.

The solid composite of the thermal break core can be made from adhesive resin with wood forming a rigid core, such as TIMBERSTRAND™ laminated strand lumber made by Weyerhaeuser. The adhesive resins and elongated woods strands can be in a ratio of 1:10. The laminated strand lumber having the feature of being recycled as well as durable.

A rigid thermal break edge is disposed around the top edge, first side edge, bottom edge and second side edge of the thermal break core forming a thermal barrier.

The rigid thermal break edge can have a width that is the same as the thickness of the thermal break core, such as 1.75 inches. The thermal break edge can have a thickness of 0.25 inches on each side covering the thermal break core.

A front metal panel is attached to a thermal break core over the rigid thermal break edge. The front metal panel has a height and width the same size as the door panel, and a thickness of ⅛th inch. The front metal panel can be made from rolled steel.

A back metal panel is secured on an opposite side of the thermal break core from the front metal panel. The back metal panel is secured over the rigid thermal break edge forming the thermally broken door panel.

The thermal break core and rigid thermal break edge prevent the front metal panel from touching the back metal panel creating the thermally broken door panel.

By preventing touching, the front metal panel can no longer transfer energy quickly and efficiently from the front of the door to the back of the door, instead a thermal break occurs. Since it is desired to keep a house at a higher temperature in winter and at a cooler temperature in summer, the thermally broken door panel with sealed elements prevents energy transfer from the metal of the front side to the metal of the back side or inside of the house.

The thermally broken single panel door with a dual support connector assembly is not only related to stopping air movement, which can also transfer energy, but is specifically related to preventing of energy transfer via metal to metal contact.

That is, with the thermally broken single panel door with a dual support connector assembly, the front panel that is metal, can no longer transfer heat directly to the back panel that is metal.

For example, when the sun is radiating on the door increasing the door panel temperature to 155 degrees Fahrenheit, the thermally broken single panel door with a dual support connector assembly prevents the heat from thermally transferring to the back panel to enter the house.

The thermally broken single panel door with a dual support connector assembly for example, prevents transfer of cold energy from the front panel to the back panel, such as when Artic air is blowing against the front panel at a temperature of −20 degrees Fahrenheit, the thermal break door prevents the energy transfer to the back panel enabling the interior of the structure to remain warmer.

The back metal panel can be identical dimensions to the front metal panel.

The back metal panel can be made from a different metal than the front metal panel and provide a different physical property, and in this example, is a thinner metal panel than the front metal panel, reducing the weight of the overall door, such as a 1/16th inch metal panel.

The assembly forming a door panel with a top side, a bottom side opposite the top side, a front and back side between the top and bottom sides, creates a thermal break by preventing the front metal panel from touching the back metal panel.

The formed thermally broken door panel can have a rectangular opening such as 24 inches by 64 inches.

An insert is fitted within the opening in the thermally broken door panel. The insert can be a double pane insulating glass unit.

A dual support connector assembly is positioned between the insert and the opening simultaneously.

The dual support connector assembly has a clip body having a pair of through holes, a door flange extending from the clip body, and an insert flange extending from the clip body in parallel with the door flange; a fixed sealing frame engages the dual support connector assembly; a front seal is between the thermally broken door panel and the fixed sealing frame for sealing the fixed sealing frame to the thermally broken door panel; a back seal is between the insert and the fixed sealing frame for sealing the fixed sealing frame to the insert; a seal-less removable frame with a seal-less removable frame profile attaches to the dual support connector assembly; and a fastener engages the clip body to the fixed sealing frame.

A reduced thermally conductive door frame for supporting the thermally broken door panel is used. The reduced thermally conductive door frame, which is made from a wood plastic composite, is attached to an opening in a facility, such as an exterior doorway to a house.

In this example, two hinges are attached to the thermally broken door panel creating a side hinged thermally broken door panel.

The thermally broken door panel with the improved dual support connector assembly without corner clips is secured between the fixed sealing frame, the insert, and the seal-less removable frame opposite the side of the fixed sealing frame without touching the seal-less removable frame creating an easily removable insert with a secure connection, which prevents and insert from breaking during severe weather, including a hurricane.

Example 2

An improved thermally broken double door assembly with a dual support connector assembly without corner clips is described in this example.

A thermal break core can be used to form the thermally broken door panel for each of the double doors.

The thermal break core can be a rigid foam for each door.

Each thermal break core for each door can be 96 inches tall and 42 inches wide and 2.25 inches in thickness.

The rigid foam of each thermal break core can be made from a polyurethane closed cell foam made from a combination of isocyanate and other polymers. The closed cell foam is durable and resistant to impacts. The closed cell foam could have a weight ranging from 2 pounds per cubic foot to 4 pounds per cubic foot.

A rigid thermal break edge is disposed around the top edge, first side edge, bottom edge and second side edge of each thermal break core forming a thermal barrier on each thermal break core.

The rigid thermal break edge can have a width the same as the thickness of the thermal break core, 2.25 inches. The thermal break edge can have a thickness of 1.0 inch on each side covering the four edges of each thermal break core.

For each thermal break core, a front metal panel is attached to a thermal break core over the rigid thermal break edge. The front metal panel has a height and width the same size as the door panel, and a thickness of ⅛th inch. The front metal panel can be made from rolled steel.

For each thermal break core, a back metal panel is secured on an opposite side of the thermal break core from the front metal panel. The back metal panel is secured over the rigid thermal break edge forming the thermally broken door panel.

On each door, the thermal break core and rigid thermal break edge prevent the front metal panel from touching the back metal panel creating the thermally broken door panel.

By preventing touching, the front metal panel can no longer transfer energy quickly and efficiently from the front of the door to the back of the door, instead a thermal break occurs. Since it is desired to keep a house at a higher temperature in winter and at a cooler temperature in summer, the thermally broken door panel with sealed elements prevents energy transfer from the metal of the front side to the metal of the back side, or inside of the house.

The thermally broken single panel door with a dual support connector assembly is not related to stopping air movement which can also transfer energy, but is specifically related to preventing of energy transfer via metal to metal contact.

That is, with the thermally broken single panel door with a dual support connector assembly, the front panel that is metal can no longer transfer heat directly to the back panel that is metal.

For example, when the sun is radiating on the door increasing the door panel temperature to 155 degrees Fahrenheit, the thermally broken single panel door with a dual support connector assembly prevents the heat from thermally transferring to the back panel to enter the house.

The thermally broken single panel door with a dual support connector assembly for example, prevents transfer of cold energy from the front panel to the back panel, such as when Artic air is blowing against the front panel at a temperature of −20 degrees Fahrenheit, the thermal break door prevents the energy transfer to the back panel enabling the interior of the structure to remain warmer.

The back metal panel can be identical dimensions to the front metal panel.

The back metal panel can be made from a different metal than the front metal panel and provide a different physical property, and in this example, is a thinner metal panel than the front metal panel, reducing the weight of the overall door, such as a 1/16th inch metal panel.

Each thermally broken door panel with a top side, a bottom side opposite the top side, a front and back side between the top and bottom sides, creates a thermal break by preventing the front metal panel from touching the back metal panel.

In this example, each formed thermally broken door panel can have a rectangular opening such as 22 inches by 80 inches.

An insert is fitted within each opening in each thermally broken door panel. The insert can be a double pane insulating glass unit.

A dual support connector assembly is positioned between the insert and the opening simultaneously for each door opening.

The dual support connector assembly has a clip body having a pair of through holes, a door flange extending from the clip body, and an insert flange extending from the clip body in parallel with the door flange; a fixed sealing frame engages the dual support connector assembly; a front seal is between the thermally broken door panel and the fixed sealing frame for sealing the fixed sealing frame to the thermally broken door panel; a back seal is between the insert and the fixed sealing frame for sealing the fixed sealing frame to the insert; a seal-less removable frame with a seal-less removable frame profile attaches to the dual support connector assembly; and a fastener engages the clip body to the fixed sealing frame.

A reduced thermally conductive door frame for supporting the two thermally broken door panels is used. The reduced thermally conductive door frame can made from wood. The reduced thermally conductive door frame is attached to an opening in a facility, such as an exterior doorway to a house.

In this example, four hinges are attached to each thermally broken door panel creating two side hinged thermally broken door panels.

Each thermally broken door panel with the improved dual support connector assembly without corner clips is secured within the fixed sealing frame.

The thermally broken door panel, the insert, and the seal-less removable frame opposite side of the fixed sealing frame without touching the seal-less removable frame create an easily removable insert with a secure connection, which prevents an insert from breaking during severe weather, including a hurricane.

Example 3

An improved thermally broken force resistant entry door having a thermally broken door panel.

The thermally broken door panel has a thermal break core comprising a non-metal material of medium density fiberboard. The thermal break core can be 28 inches wide by 96 inches high with a thickness of 2 inches.

The thermal break core is surrounded by a rigid thermal break edge.

The rigid thermal break edge is an extruded polyvinyl chloride. The rigid thermal break edge is glued with an adhesive seamlessly to a top edge, a first side edge, a bottom edge and a second side edge of the thermal break core forming a thermal barrier around the thermal break core.

The rigid thermal break has a thickness between 5 millimeters and 100 millimeters.

A front metal panel made of stainless steel is secured to one side of the thermal break core.

A back metal panel made of aluminum is secured to an opposite side of the thermal break core opposite the front metal panel forming the thermally broken door panel.

The metal panels are secured with a polyurethane adhesive.

The thermal break core with rigid thermal break edge prevents thermal energy transfer from the front metal panel to the back metal panel in a range from 10 degrees to 60 degrees Fahrenheit.

A reduced thermally conductive door frame made of an extruded polyvinyl chloride is attached to a facility for supporting the thermally broken door panel additionally preventing thermal energy transfer in a range from 10 degrees to 60 degrees Fahrenheit from the outside of the facility to an inside of the facility. It is important to note that the reduced thermally conductive door frame is not a metal door frame.

A metal reinforcement member that is 0.25 inches in thickness, and 3 inches in width is mounted to a facility opening and connecting to the thermally insulating door frame. The metal reinforcing member can be contiguous or formed of a plurality of separate segments.

Two hinges can be used to attach to the top and bottom edges of the thermally broken door panel and to the reduced thermally conductive door frame in a pivoting relationship.

The improved thermally broken force resistant entry door not only provides the thermal protections from the exterior heat and cold but additionally and simultaneously resists forced entry using pressures from 10 psi to 500 psi.

While these embodiments have been described with emphasis on the embodiments, it should be understood that within the scope of the appended claims, the embodiments might be practiced other than as specifically described herein.

What is claimed is:

1. An improved door assembly with a dual support connector assembly and without corner clips comprising:

a. a thermally broken door panel comprising;
   (i) a thermal break core comprising a solid composite;
   (ii) a rigid thermal break edge disposed around a top edge, a first side edge, a bottom edge and a second side edge of the thermal break core forming a thermal barrier;
   (iii) a front metal panel secured to one side of the thermal break core over the rigid thermal break edge;
   (iv) a back metal panel secured on an opposite side of the thermal break core over the rigid thermal break edge forming the thermally broken door panel, the thermally broken door panel preventing the front metal panel from touching the back metal panel;
   (v) an opening in the thermally broken door panel;
   (vi) an insert fitting within the opening in the thermally broken door panel;
   (vii) a dual support connector assembly positioned between the insert and the opening simultaneously, the dual support connector assembly comprising:
      1. a clip body having a pair of through holes;
      2. a door flange extending from the clip body; and
      3. an insert flange extending from the clip body in parallel with the door flange;
   (viii) a fixed sealing frame engaging the dual support connector assembly;
   (ix) a front seal between the thermally broken door panel and the fixed sealing frame for sealing the fixed sealing frame to the thermally broken door panel;
   (x) a back seal between the insert and the fixed sealing frame for sealing the fixed sealing frame to the insert;
   (xi) a seal-less removable frame with a seal-less removable frame profile for attaching to the dual support connector assembly;
   (xii) a fastener engaging the clip body to the fixed sealing frame;
b. a reduced thermally conductive door frame attached to a facility for supporting the thermally broken door panel;
c. a plurality of hinges affixing the thermally broken door panel to the thermally insulating door frame in a pivoting relationship, and
   wherein the thermally broken door panel with the improved dual support connector assembly without corner clips is secured between the fixed sealing frame, the thermally broken door panel, the insert, and the seal-less removable frame opposite side of the fixed sealing frame without touching the seal-less removable frame creating an easily removable insert with a secure connection, which prevents and insert from breaking during severe weather, including a hurricane.

2. The improved door assembly with the dual support connector assembly without corner clips of claim 1, wherein the fixed sealing frame comprises:

a. a fixed sealing frame profile;
b. a door contact surface 40 extending from the fixed sealing frame profile;
c. a side flex and sealing gap surface extending from the door contact surface forming an upper flex and sealing gap between the door contact surface and the side flex and sealing gap surface;

d. a lower flex and sealing gap surface extending from the side flex and sealing gap surface forming a first channel engagement member;

e. a second channel engagement member formed in parallel to the first channel engagement member creating an first alignment cavity;

f. a flex gap formed between the second channel engagement member and a first glass contact surface; and g. a second glass contact surface formed in parallel to the first glass contact surface containing the first seal and extending to the fixed sealing frame profile.

3. The improved door assembly with the dual support connector assembly without corner clips of claim 1, comprising a textured surface, a smooth surface or a woodgrain surface formed on at least one: the fixed sealing frame profile and the seal-less removable frame profile.

4. The improved door assembly with dual support connector assembly without corner clips of claim 1, comprising a shape for the fixed sealing frame profile and the seal-less removable frame profile are selected from the group: rectangle, rectangle with rounded edges, a half round, or a decorative molding shape.

5. The improved door assembly with the dual support connector assembly without corner clips of claim 1, comprising a coating layer on the fixed sealing frame profile wherein the coating layer consists of a stain, a paint, a sealant or a primer.

6. The improved door assembly with the dual support connector assembly without corner clips of claim 1, wherein the door flange comprises a door flange lip extending at an angle from 80 degrees to 100 degrees from a central axis of the clip body.

7. The improved door assembly with the dual support connector assembly without corner clips of claim 1, wherein the glass flange comprises a glass flange lip extending at an angle from 80 degrees to 100 degrees from the central axis of the clip body.

8. The improved door assembly with the dual support connector assembly without corner clips of claim 1, wherein the glass panel comprises a plurality of glass panes.

9. The improved door assembly with the dual support connector assembly without corner clips of claim 1, comprising glass panes separated by a spacer/sealant.

10. The improved door assembly with the dual support connector assembly without corner clips of claim 1, wherein the height of the door flange and the height of the glass flange are unequal.

11. The improved door assembly with the dual support connector assembly without corner clips of claim 1, wherein the seal-less removable frame comprises:

a. a seal-less removable frame profile with a coating layer;

b. a door contact surface extending from the seal-less removable frame profile;

c. a first side gap surface extending from the door contact surface;

d. a second side gap surface extending from the first side gap surface forming a rigid gap;

e. a first alignment channel member;

f. a first clip surface formed on the first alignment channel member;

g. a second alignment channel member in parallel with the first alignment channel member creating a second alignment cavity;

h. a second clip surface formed on the second alignment channel member;

i. a third side gap surface extending from the second clip surface;

j. a rigid gap formed between the second alignment channel member and a fourth side gap surface;

k. a first glass contact surface; and l. a second glass contact surface formed in parallel to the first glass contact surface with the second glass contact surface extending to the seal-less removable frame profile.

12. The improved door assembly with the dual support connector assembly without corner clips of claim 11, wherein the coating layer consists of a stain, a paint, a sealant, and a primer.

13. An improved thermally broken force resistant entry door comprising:

a. a thermally broken door panel comprising:

(i) a thermal break core comprising a non-metal material;

(ii) a rigid thermal break edge disposed around a top edge, a first side edge, a bottom edge and a second side edge of the thermal break core forming a thermal barrier, wherein the rigid thermal break edge has a thickness between 5 millimeters and 100 millimeters;

(iii) a front metal panel secured to one side of the thermal break core;

(iv) a back metal panel secured to an opposite side of the thermal break core opposite the front metal panel forming the thermally broken door panel; and wherein the thermal break core with rigid thermal break edge prevents thermal energy transfer from front metal panel to back metal panel in a range from 10 degrees to 60 degrees Fahrenheit;

b. a reduced thermally conductive door frame attached to a facility for supporting the thermally broken door panel additionally preventing thermal energy transfer in a range from 10 degrees to 60 degrees Fahrenheit from the outside of the facility to an inside of the facility, wherein the reduced thermally conductive door frame is not a metal door frame;

c. a metal reinforcement member mounted to a facility opening and connecting to the thermally insulating door frame; and d. a plurality of hinges affixing the thermally broken door panel to the reduced thermally conductive door frame in a pivoting relationship, wherein the improved thermally broken force resistant entry door resists forced entry using pressures from 10 psi to 500 psi.

14. The improved thermally broken force resistant entry door of claim 13 wherein at least of: the thermally insulating door frame and the rigid thermal break comprise either: (i) a wood plastic composite of a blend of wood flour and polyvinyl chloride or (ii) wood.

15. The improved thermally broken force resistant entry door of claim 13, wherein the front metal panel and the back metal panel have a thickness between 0.2 mm to 4 mm.

16. The improved thermally broken force resistant entry door of claim 13, wherein each hinge is a pin hinge having a first segment providing a receptacle portion for receiving a projecting portion from a second segment for quick installation.

17. The improved thermally broken force resistant entry door of claim 13, wherein the metal reinforcement member comprises steel, aluminum and has a thickness from 28 gauge to 5 gauge steel or aluminum and have width from 1 inch to the width of the thermally insulating door frame.

18. The improved thermally broken force resistant entry door of claim 13, comprising a powder coating or a paint disposed over the door panel and the thermally insulating door frame.

* * * * *